US010213794B1

(12) United States Patent
Miller et al.

(10) Patent No.: US 10,213,794 B1
(45) Date of Patent: Feb. 26, 2019

(54) CYCLONE SEPARATOR WITH FLOW ALTERING BAFFLES

(71) Applicant: Van Tongeren America LLC, Lebanon, PA (US)

(72) Inventors: James Miller, Lebanon, PA (US); Adam Brandt, Sterling, VA (US); William Sinton, Auburn, PA (US); Mark Noppenberger, Lebanon, PA (US); Scott Davies, Lebanon, PA (US)

(73) Assignee: Van Tongeren America LLC, Lebanon, PA (US)

( * ) Notice: Subject to any disclaimer, the term of this patent is extended or adjusted under 35 U.S.C. 154(b) by 0 days.

(21) Appl. No.: 15/795,275

(22) Filed: Oct. 27, 2017

Related U.S. Application Data

(60) Provisional application No. 62/423,848, filed on Nov. 18, 2016.

(51) Int. Cl.

| | |
|---|---|
| ***B04C 5/14*** | (2006.01) |
| ***B04C 5/103*** | (2006.01) |
| ***B04C 5/13*** | (2006.01) |
| ***B04C 3/06*** | (2006.01) |
| ***B04C 5/04*** | (2006.01) |
| ***B04C 5/181*** | (2006.01) |
| *B04C 11/00* | (2006.01) |

(52) U.S. Cl.
CPC ..... *B04C 5/103* (2013.01); *B04C 3/06* (2013.01); *B04C 5/04* (2013.01); *B04C 5/13* (2013.01); *B04C 5/14* (2013.01); *B04C 5/181* (2013.01); *B04C 11/00* (2013.01); *B04C 2005/136* (2013.01)

(58) Field of Classification Search
CPC .. B04C 5/14; B04C 5/15; B04C 5/181; B04C 3/06; B04C 5/04; B04C 5/13; B04C 5/103; B04C 2005/136
USPC ..... 209/720
See application file for complete search history.

(56) References Cited

U.S. PATENT DOCUMENTS

| | | | | |
|---|---|---|---|---|
| 3,802,570 | A | 4/1974 | Dehne | |
| 4,810,264 | A * | 3/1989 | Dewitz | B04C 5/103 210/512.3 |
| 5,129,931 | A * | 7/1992 | Oranje | B01D 45/16 55/399 |
| 5,314,611 | A * | 5/1994 | Cetinkaya | C10G 11/18 208/113 |
| 5,538,696 | A * | 7/1996 | Raterman | B01D 45/12 422/147 |
| 5,869,008 | A * | 2/1999 | Dewitz | B01J 8/0055 208/161 |
| 6,228,151 | B1 | 5/2001 | Conrad | |
| 6,468,321 | B2 * | 10/2002 | Kinsel | B01D 45/14 55/457 |
| 8,192,614 | B2 * | 6/2012 | Niccum | B01J 8/0055 208/113 |
| 8,398,751 | B2 * | 3/2013 | Yang | B01D 21/26 422/144 |

(Continued)

*Primary Examiner* — Joseph C Rodriguez
(74) *Attorney, Agent, or Firm* — Duncan Galloway Egan Greenwald PLLC; Theresa Camoriano; Guillermo Camoriano

(57) ABSTRACT

A cyclone separator includes a cyclone separator wall and a hopper wall defining an interior space, and a plurality of baffles located in the interior space to assist in minimizing particle re-entrainment, reduce erosion, and reduce pressure losses.

14 Claims, 11 Drawing Sheets

(56) References Cited

U.S. PATENT DOCUMENTS

| | | | | |
|---|---|---|---|---|
| 8,617,405 | B2 * | 12/2013 | Hopper | B01D 17/0217<br>210/787 |
| 9,022,231 | B1 * | 5/2015 | Ford | B04C 9/00<br>210/512.1 |
| 9,248,456 | B2 * | 2/2016 | Ford | B04C 5/04 |
| 9,675,918 | B2 * | 6/2017 | Loh | B04C 5/06 |

* cited by examiner

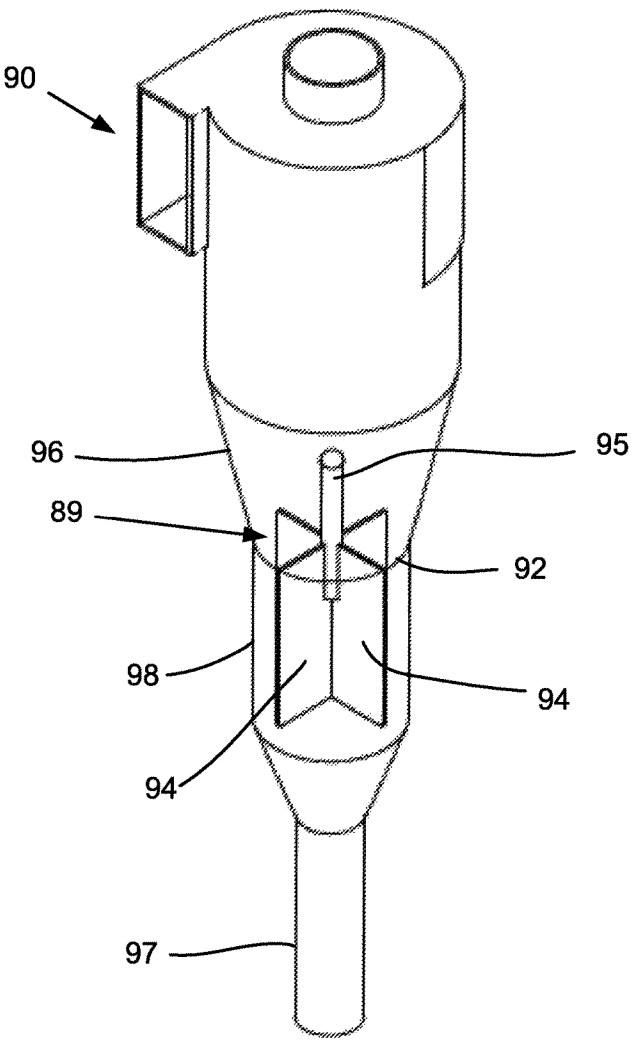
Fig 14
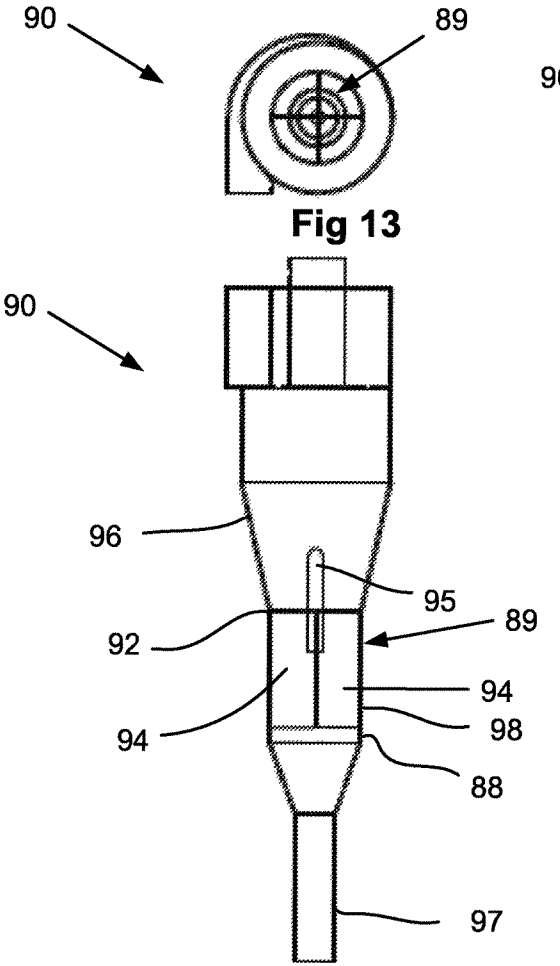
Fig 13
Fig 12

110
109

110
116
112
109
114
118
114
117

110
116
112
114
109
118
114
117

CYCLONE SEPARATOR WITH FLOW ALTERING BAFFLES

This application claims priority from U.S. Provisional Application Ser. 62/423,848 filed Nov. 18, 2016.

The present invention relates to cyclone separators for separating particulates from a fluid stream. More particularly, it relates to a cyclone separator that includes a baffle located in proximity with the lowest point of the primary vortex formed in the device in order to change the flow characteristics of the particles to minimize erosion and to minimize re-entrainment of particles to the gas discharge stream. The design also reduces pressure drops and increases collection efficiency as compared to the traditional equivalent size and model cyclone.

A cyclone separator is an apparatus used for removing particulate matter from a fluid stream, primarily by means of centripetal forces. This separation activity occurs inside of a cylindrical and/or frusto-conical housing. A gas/solid particles mixture enters the body of the cyclone via an inlet duct that is substantially tangentially oriented to the main body of the cyclone. The inlet is offset horizontally to initiate the spiral motion of the particles to be removed or recovered from the mixture. The centripetal acceleration of the flow of the gas/solid particles mixture throws the particles against the wall of the cyclone separator body. Gravity and tangential velocity continue to carry the free particles around the interior wall of the cyclone separator body, traveling in a helix or corkscrew pattern until the particles reach the lower outlet hopper which is connected to the bottom of the cyclone.

The diameter of a standard cyclone usually tapers to a reduced diameter at the bottom of the cyclone, adjacent to the hopper. It is in this reduced diameter area that the centripetal acceleration reaches a maximum. The goal is for the particles to fall down into the bottom of the hopper, where they can then flow out the bottom of the hopper through a dip leg. Unfortunately, because the air flow turns upwardly to flow upwardly through the center of the cyclone separator body in order to exit the cyclone separator body, the upward air flow and the rotational air flow tend to re-entrain some of the particles that already have been separated out. For those particles, the downward force from gravity acting on the particles is balanced or exceeded by the force exerted on the particles by the upwardly flowing air. This prevents those particles from dropping out of the hopper unless acted upon by another force.

Some of the particles remain at equilibrium, neither falling out of the air flow nor being lifted out through the top of the cyclone. Those particles continue spinning horizontally about the cyclone hopper's interior wall, which abrades the lining material of the hopper, causing localized premature wear and failure. Not only do the particles erode the wall of the hopper, but the constant rubbing of the wall by the particles causes the particles themselves to erode as well; causing the particles to become smaller in volume and mass. When the particles decrease in mass to the degree in which an equilibrium of forces is no longer present, the particles break free from the centripetal forces (caused by the rotational air flow) and become re-entrained in the upwardly-flowing, exiting gas stream, thus reducing the collection efficiency of the cyclone.

In some situations in which a cyclone separator is used, the particulate material is extremely abrasive and/or costly. Preventing the extended residence time of the particulate material in the lower cyclone/hopper area reduces premature wear of the cyclone/hopper, increases the reliability and efficiency of the cyclone, and lowers maintenance requirements. When the particulate material is a costly catalyst material in an arrangement where the cyclone operates in a recirculation loop that removes a portion of said catalyst from the gas stream, the particles that do not exit the loop are subject to attrition by way of being constantly circulated. After several cycles through the loop, the particulate material will need to be replaced with additional fresh catalyst, as attrition will reduce the available surface area on the particles for reaction. Adding fresh catalyst because of premature attrition is an expensive proposition. Cyclones with low erosion/attrition characteristics and the ability to provide high collection efficiency will reduce the amount of fresh catalyst that needs to be added, thus reducing operating expenses.

In the past, it has been theorized that a centrally located body, placed approximately near the bottom (or antapex) of the naturally occurring vortex inside of a cyclone will anchor that vortex. It also has been theorized that anchoring the vortex reduces the re-entrainment of separated particles, thereby increasing the cyclone's overall efficiency. While such a vortex-anchoring device may increase efficiency, it also may reduce reliability. For example, in some cases, the vortex-anchoring device comes loose from the wall of the lower cyclone/hopper, falls down, wedges against the wall of the hopper and forms a plug that prevents the particles from falling through the hopper and out the bottom of the hopper. This type of failure is catastrophic to a properly operating collection system, requiring complete unit shutdown for repairs.

Therefore, a need exists for an improvement that upgrades the efficiency and reliability of the cyclone. Also, an added benefit of improving the flow characteristics of the cyclone is a reduction in the pressure drop, which could result in very beneficial energy savings.

SUMMARY

An embodiment of the present invention provides a cyclone separator with flow altering baffles located in proximity to the lowest point of the primary vortex. These thin-walled baffles slow the rotational flow of the gas at the bottom of the cyclone, which helps the particles fall out of the gas stream and reduces erosion in a normally high erosion area in the lower section of the cyclone. The baffles also reduce re-entrainment by keeping the particles in the descending vortex flow from traveling to the ascending vortex flow. In addition, pressure losses are reduced by reducing gas friction on the internal surface of the cyclone.

BRIEF DESCRIPTION OF THE DRAWINGS

FIG. 12 is a side view, similar to that of FIG. 2, of another embodiment of a cyclone separator;

FIG. 13 is a plan view of the cyclone separator of FIG. 12;

FIG. 14 is a perspective view of the cyclone separator of FIG. 12;

DESCRIPTION

Figure 1:
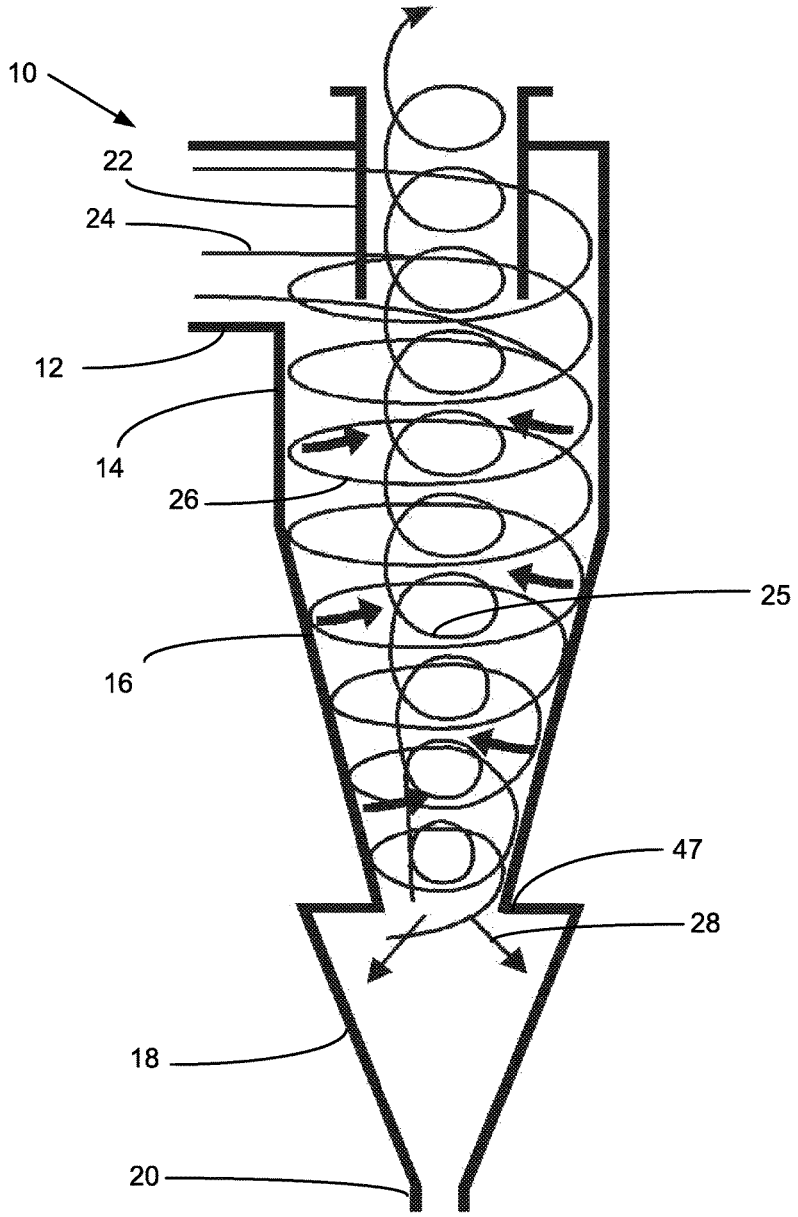
Fig 1 Prior Art
FIG. 1 is a schematic view of a prior art cyclone separator.

FIG. 1 shows a conventional prior art cyclone 10 which includes an inlet duct 12, a main barrel 14, a frusto-conical portion 16, a frusto-conical hopper 18 at the bottom of the frusto-conical portion 16, a dip leg 20 at the bottom of the hopper 18, and an outlet tube 22 in the center of the main barrel 14. The cyclone 10 has a central, vertical axis. A particulate-laden fluid stream 24 is admitted into the cyclone 10 via the inlet duct 12, which is tangent to the main barrel 14. The tangential orientation of the inlet duct 12 initiates the motion of the fluid stream 24, which then proceeds to travel in a spiral pattern down the main barrel 14 and down the frusto-conical portion 16 of the cyclone 10, toward the hopper 18. As the frusto-conical portion 16 tapers down to a smaller diameter, the acceleration of the fluid stream 24 increases, which increases the centripetal force throwing the solids in the fluid stream 24 against the inner wall of the cyclone 10. The top of the hopper 18 has a larger diameter than the bottom of the frusto-conical portion 16 of the cyclone 10, where the hopper 18 joins the frusto-conical portion 16 of the cyclone 10. The gap between the larger diameter top of the hopper 18 and the smaller diameter bottom of the frusto-conical portion 16 of the cyclone 10 is filled by a toroidal plate 47, which is welded to the top of the hopper 18 and to the bottom of the cyclone 10 to provide a seal between the hopper 18 and the cyclone 10. As the fluid stream 24 reaches the smaller-diameter bottom of the cyclone 10 and enters the larger-diameter top of the hopper 18, the sudden change in diameter reduces the rotational velocity of the fluid stream 24. That reduction in rotational velocity, together with the change in direction of the fluid stream 24 as it forms a vortex 25 to travel up through the outlet tube 22 to exit the cyclone 10, causes most of the particulates to drop out of the fluid stream 24 (as shown at 28) so the particulates can exit the cyclone 10 through the bottom of the hopper 18, at the dip leg 20.

Unfortunately, the attrition of the particulates as they spiral down the main barrel 14 and the frusto-conical portion 16 of the cyclone 10 results in a reduction of the size and mass of the particulates. This makes it easier for the particulates to be re-entrained into the vortex 25 exiting the cyclone 10. These re-entrained particulates exit the cyclone 10 through the outlet tube 22 instead of being removed through the hopper 18 and dip leg 20, which reduces the overall particulate-removal efficiency of the cyclone 10.

FIGS. 2-5 show a cyclone 30 incorporating a first embodiment of a baffle arrangement 29 designed to reduce re-entrainment of the particles as they exit the frusto-conical portion 36 at the bottom of the cyclone 30 and enter the hopper 38, as explained below.

This particular cyclone 30 includes the same components found in the prior art cyclone 10 of FIG. 1, such as a tangential feed inlet 32, a main barrel 34, a frusto-conical portion 36, a hopper 38, and a dip leg 40. It also has a central vertical axis. It also has a baffle arrangement 29, which is described below. It may be noticed that the frusto-conical portion 36 of this cyclone 30 is shorter than in the prior art cyclone 10 of FIG. 1. It has been found that the increase in particulate-removal efficiency from the use of the baffle arrangement 29 permits this shortened conical portion 36. This has the added advantage that some existing cyclone installations may be retrofitted with the hopper 38 and baffle arrangement 29 of FIGS. 2-5 within the same vertical space as the original cyclone. Another advantage is that the shorter barrel of this cyclone 30 (the total height of the cylindrical portion 34 and frusto-conical portion 36) results in a lower pressure drop across the cyclone 30 and therefore lower energy usage.

At the top edge 46 of the hopper 38 is a horizontal, toroidal plate 47 (See FIG. 4) that extends from the larger diameter top edge 46 of the hopper 38 to the smaller-diameter bottom edge 49 of the frusto-conical portion 36 of the cyclone 30 to close off the gap between the top edge 46 of the hopper 38 and the bottom edge 49 of the cyclone 30 and to join the top edge 46 of the hopper 38 to the bottom edge 49 of the cyclone 30. This toroidal plate 47 may be welded, bolted, or otherwise secured to the hopper 38 and to the cyclone 30 to create a seal between the hopper 38 and the cyclone 30.

In this embodiment, the baffle arrangement 29 includes four thin-walled baffles 42, which are located inside the hopper 38 and which divide the volume inside the hopper 38 into four equal, open quadrants, each open quadrant providing a pathway for fluid communication between the bottom of the conical portion 36 and the dip leg 40. Each baffle 42 defines an upper or leading edge 44 located at substantially the same elevation as the toroidal plate 47 and the top edge 46 of the hopper 38. Each baffle 42 extends downwardly to its bottom or trailing edge 48. The height of the baffles 42 in the vertical direction may vary with the application, but the vertical height of the baffles 42 is generally between 0.75 to 1.0 times the diameter of the barrel 34. It is preferred that the vertical height of the baffles be at least as great as the horizontal radius of the top edge of the hopper 38 for most of the widthwise extent of the baffles. While these baffles 42 are oriented vertically, it is understood that the baffles may alternatively extend at an angle to the vertical, but in that case they would still have a height that could be measured in the vertical direction. The baffles have thin walls. The vertical height of the baffles is at least five times the thickness of the thin walls of the baffles and preferably at least ten times the thickness of the thin walls of the baffles.

The outer edge of each baffle 42 abuts the frusto-conical inner surface of the wall of the hopper 38 along the full length of the baffle 42, so the outer edge of each baffle 42 tapers inwardly as the wall of the hopper 38 tapers inwardly. The inner edge of each baffle 42 terminates at the central, vertical axis of the cyclone 30. Thus, each of the baffles 42 has a widthwise extent from an outer edge adjacent to the hopper wall to an inner edge adjacent to the central vertical axis. It is preferred that each baffle 42 have a widthwise extent that is greater than half of the radial distance from the central vertical axis to the hopper wall, and more preferable that each baffle 42 have a widthwise extent that extends the full radial distance from the central vertical axis to the hopper wall. The baffle arrangement 29 is supported by the inner surface of the frusto-conical wall of the hopper 38. The baffle arrangement 29 may simply rest on or be wedged against or be attached by welded metal to the hopper wall. Since the baffles 42 have the same taper as the wall of the hopper 38, and since the baffles 42 are connected to each other to span across the hopper 38, the assembly of baffles 42 will simply fall down in the hopper 38 until the diameter of the baffle arrangement 29 matches the inside diameter of the hopper 38 and the baffles 42 rest on the hopper wall. In this "fallen-down" position, the baffle arrangement 29 provides paths for fluid to flow from the cyclone 30, through the spaces between the baffles 42, through the hopper 38, to the dip leg 40. Thus, there is no concern that the baffle arrangement 29 may come free from the walls of the hopper 38 and fall down to create a plug that prevents or impedes fluid flow through the hopper 38.

The weight of the baffle arrangement 29 and friction between the baffle arrangement 29 and the inner surface of the wall of the hopper 38 are generally sufficient to keep the baffle arrangement 29 in place without rotating or spinning even during operation of the cyclone 30, when the full force of the spiraling fluid stream 24 impacts against the baffles 42, as explained later with respect to FIG. 5. However, if desired, the baffle arrangement 29 may be secured to the inner surface of the wall of the hopper 38, as by welding, tack welding, or bolting via brackets (not shown), if desired.

In a preferred embodiment, the baffle arrangement 29 is manufactured out of a thin-walled metal alloy plate, such as carbon steel or stainless steel, to match the metallurgy of the cyclone 30. However, the baffle arrangement 29 may alternatively be made from other materials. For example, and with temperature permitting, the complete baffle arrangement 29 may be molded out of an engineered plastic that meets specific corrosion resistance or abrasion resistance criteria. If the solids being recovered are particularly abrasive, the baffle arrangement 29 may be molded from a very tough engineered plastic and may be designed to be replaced on a relatively frequent but economical basis.

The baffle arrangement 29 also includes a vortex-anchoring device 50, projecting upwardly above the hopper 38 and into the interior of the cyclone. In this instance, the vortex-anchoring device 50 is a circular cross-section, convex-side-up body 52 and a centrally-located pin 54 projecting upwardly from the body 52 along the central, vertical axis of the cyclone 30. In this embodiment, the body 52 is welded to the tops of the baffles 42. The pin 54 has slots in its lower portion that receive the baffles 42, with the remainder of the pin 54 resting on top of the baffles 42. As may be appreciated in other embodiments described later, the body 52 may have other shapes, and it may range in diameter from zero (in which no body is present) to about 0.4 times the diameter of the barrel 34. Preferably, the diameter of the body 52 is from 0.1 to 0.4 times the diameter of the barrel 34.

Figure 5:
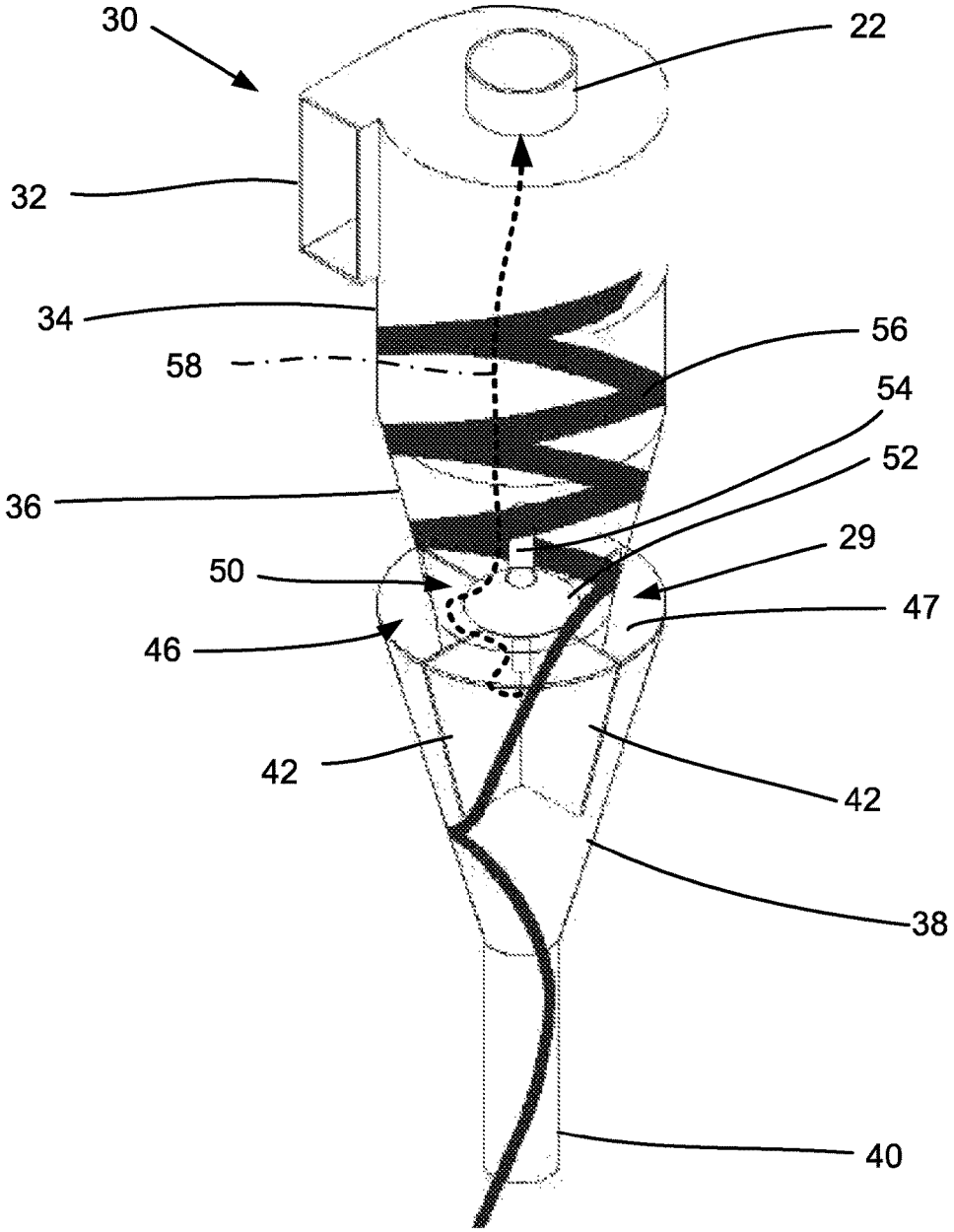
FIG. 5 is a schematic view, similar to that of FIG. 1, but for the embodiment of FIG. 2, showing the helical flow of the particles as they proceed through the cyclone separator.

FIG. 5 shows the helical flow path 56 of the particles as they spiral down through the cyclone 30. Note that, as the particles drop below the transition 46 between the bottom of the cyclone 30 and the top of the hopper 38, they impinge against the baffles 42 of the baffle arrangement 29, losing most of their rotational velocity and dropping into the dip leg 40 in order to flow out through the bottom of the dip leg 40. The dotted line 58 depicts the circuitous path followed by the portion of the gas stream that drops below the body 52. That gas stream changes direction several times as it winds around the baffles 42 and the body 52 before it joins the main portion of the gas stream flowing up the central vortex 25 (See FIG. 1) to exit the cyclone 30 via the central outlet duct 22. The changes in direction of the gas stream provide additional opportunities for any particles being carried by this stream to disengage and fall down through the spaces between the baffles 42 and into the dip leg 40. The pin 54, located adjacent the antapex (or lowest point) of the vortex 25, serves to anchor the antapex of the vortex 25 so it remains centrally located such that the vortex 25 does not "wander" around, possibly vacuuming up any particles before they have had a chance to impinge against the baffles 42 and drop down to the dip leg 40.

Figure 8:
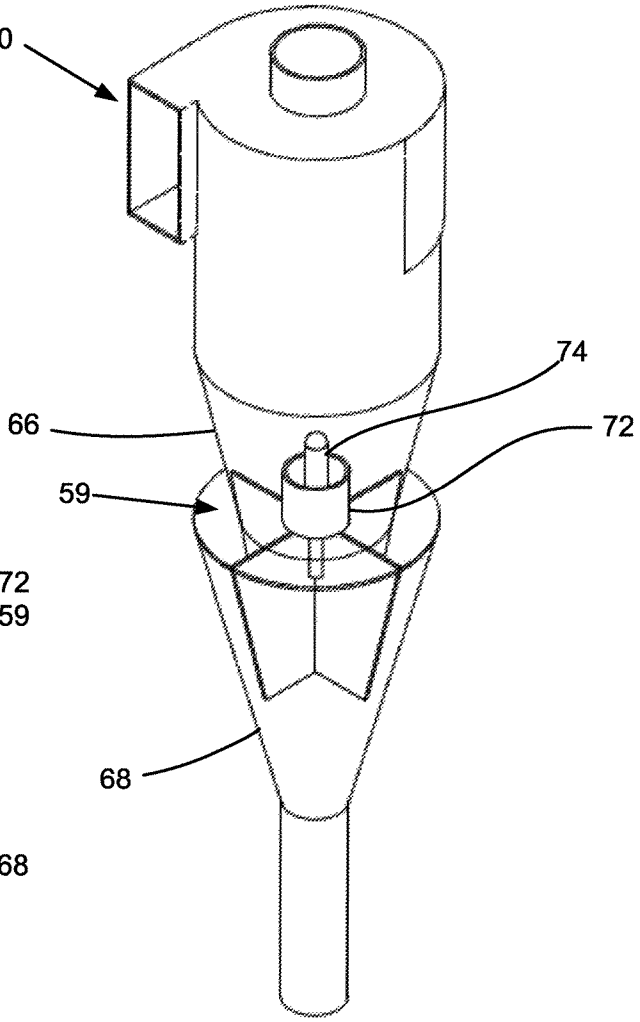
FIG. 8 is a perspective view of the cyclone separator of FIG. 6.
Figure 7:
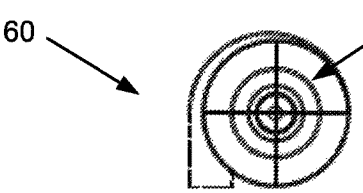
FIG. 7 is a plan view of the cyclone separator of FIG. 6.
Figure 6:
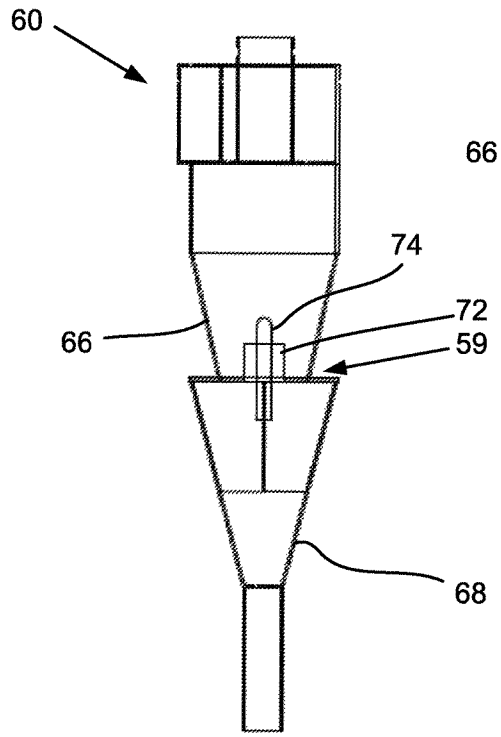
FIG. 6 is a side view, similar to that of FIG. 2, of another embodiment of a cyclone separator.

FIGS. 6 through 8 show a cyclone 60 incorporating another embodiment of a baffle arrangement 59 designed to prevent re-entrainment of the particulates as they exit the frusto-conical portion 66 of the cyclone 60 and enter the hopper 68, as explained below.

Figure 4:
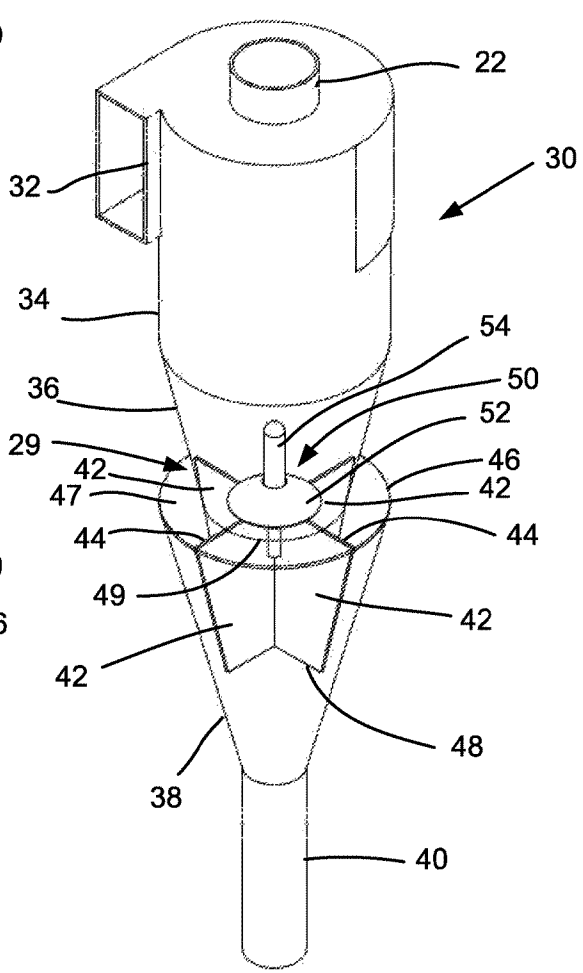
FIG. 4 is a perspective view of the cyclone separator of FIG. 2.
Figure 3:
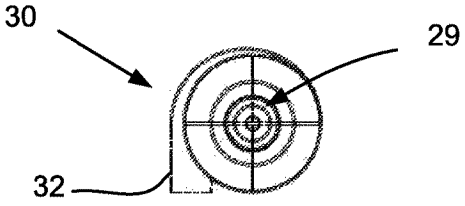
FIG. 3 is a plan view of the cyclone separator of FIG. 2.
Figure 2:
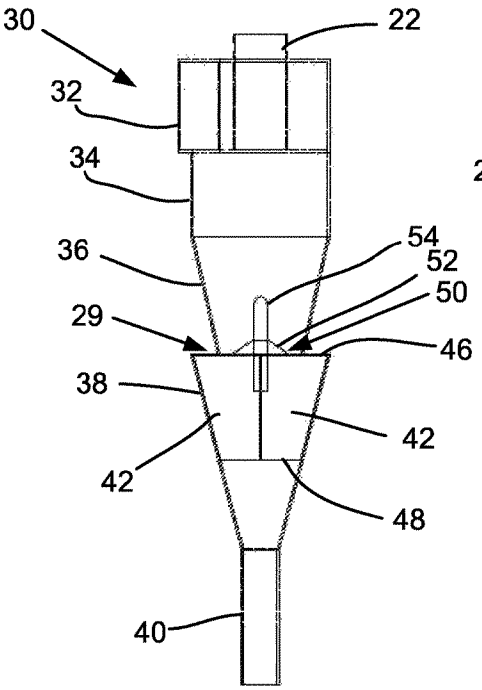
FIG. 2 is a side view of a cyclone separator made in accordance with an embodiment of the present invention, with the housing of the cyclone being shown as transparent so the internal parts may be seen. This convention of showing the housing as being transparent is followed in all ensuing figures.

This embodiment is very similar to the previous embodiment of FIGS. 2-5. The only substantial difference is that the body 52 of FIG. 4 is replaced by a short, hollow cylinder 72 mounted coaxially with the vortex-anchoring pin 74 and with the axis of the cyclone 60. The cylinder 72 is welded to the top of the baffles, and the pin 74 has slots in its lower portion that receive the baffles, with the remainder of the pin 74 resting on top of the baffles. The operation of this cyclone 60 is substantially identical to the operation of the cyclone 30 described earlier.

Figure 11:
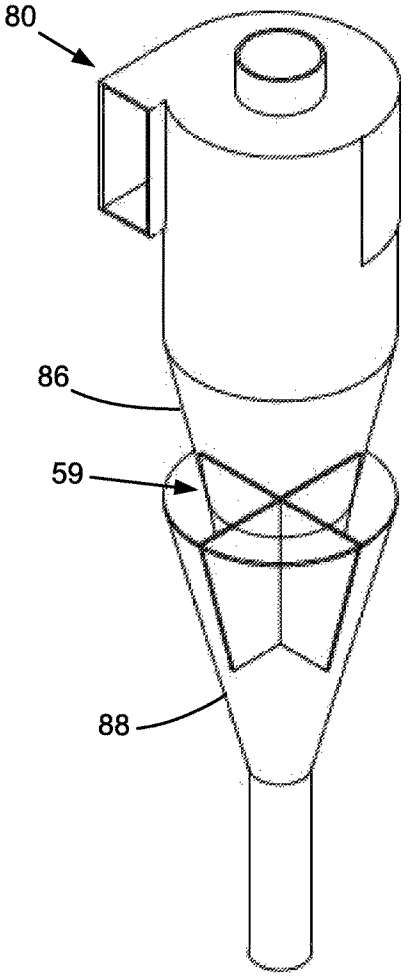
FIG. 11 is a perspective view of the cyclone separator of FIG. 9.
Figure 10:
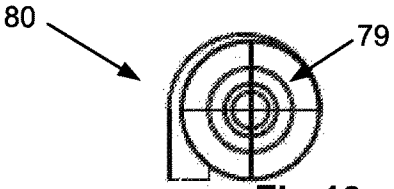
FIG. 10 is a plan view of the cyclone separator of FIG. 9.
Figure 9:
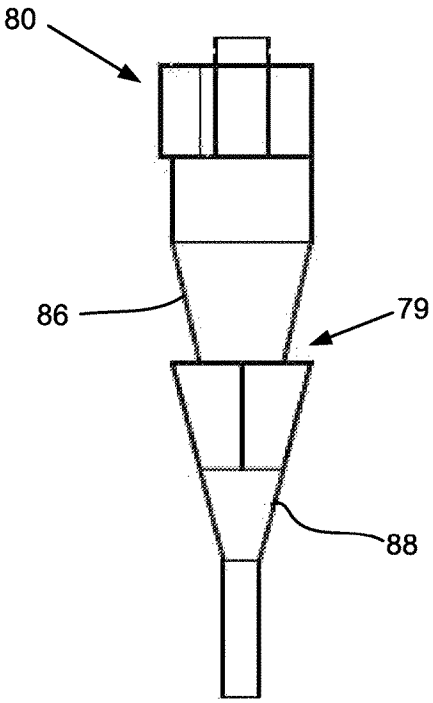
FIG. 9 is a side view, similar to that of FIG. 2, of another embodiment of a cyclone separator.

FIGS. 9 through 11 show a cyclone 80 incorporating another embodiment of a baffle arrangement 79 designed to prevent re-entrainment of the particulates as they exit the frusto-conical portion 86 of the cyclone 80 and enter the hopper 88, as explained below.

As may be appreciated, this embodiment of the baffle arrangement 79 is very similar to the baffle arrangement 29 of FIGS. 2-5. The only substantial difference is that the body 52 and the vortex-anchoring pin 54 of FIG. 4 have been completely eliminated.

FIGS. 12 through 14 show a cyclone 90 in which the upper portion of the hopper 98 is cylindrical (instead of being frusto-conical as shown in the previous embodiments), and there is no transition piece wherein the diameter of the hopper 98 abruptly increases beyond the diameter of the bottom of the frusto-conical portion 96 of the cyclone 90. Instead, the diameter of the top of the hopper 98 is the same as the diameter at the bottom of the cyclone 90, so the transition at 92 does not include a toroidal plate to adapt between the two diameters where the top edge of the hopper connects to the bottom edge of the cyclone wall. With respect to the baffle arrangement 89, it is similar to the baffle arrangement 29 of FIG. 4 except that the baffles 94 are rectangular plates, since the upper portion of the wall of the hopper 98 is not tapered. The vortex-anchoring member in this embodiment is the pin 95. The baffles 94 may rest on the tapered wall in the lower portion of the hopper 98, or the baffles 94 may be secured to the vertical wall of the hopper 98 by welding or by brackets, or both.

The operation of this cyclone 90 is substantially identical to the operation of the cyclones described earlier, with the main difference being the absence of the abrupt increase in diameter at the transition point 92 between the cyclone cone 96 and the hopper cylinder 98. Despite the absence of the abrupt increase in diameter to slow down the rotational velocity of the fluid stream so as to allow the particles to disengage from the fluid stream and fall down through the bottom of the hopper to the dip leg 97, the baffles 94 function in the same manner as the baffles 42 of FIG. 5, wherein the particles impinge against the baffles 94 and are forced to stop their rotational motion and drop down to the dip leg 97.

Figure 17:
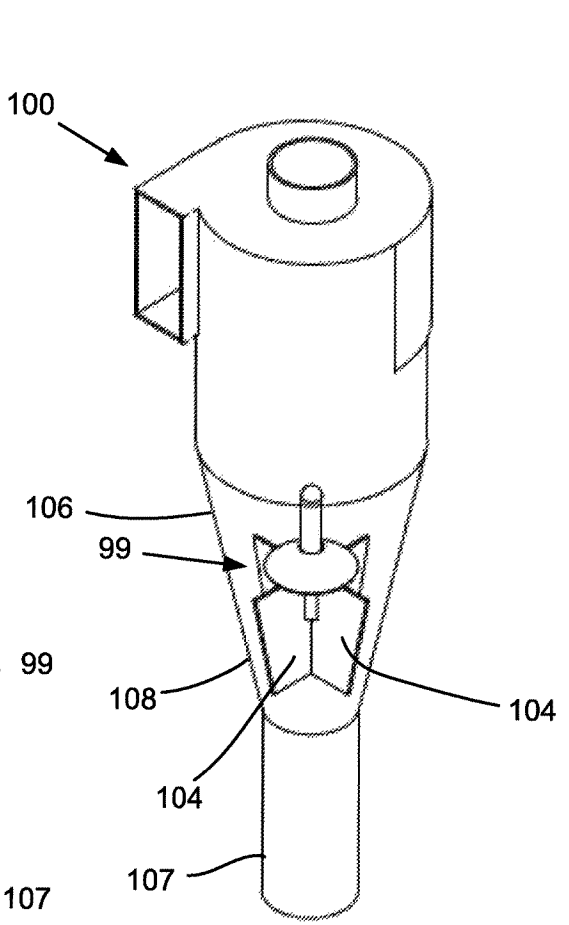
FIG. 17 is a perspective view of the cyclone separator of FIG. 15.
Figure 16:
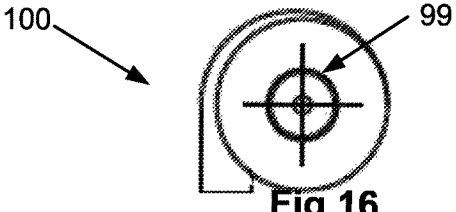
FIG. 16 is a plan view of the cyclone separator of FIG. 15.
Figure 15:
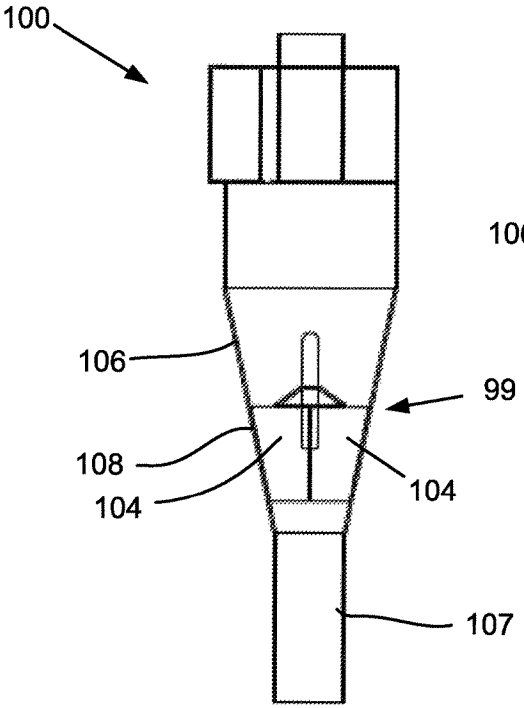
FIG. 15 is a side view, similar to that of FIG. 12, of another embodiment of a cyclone separator.

FIGS. 15 through 17 show a cyclone 100 in which there is a continuous taper from the frusto-conical portion 106 of the cyclone to the hopper 108.

As may be appreciated, in this embodiment of the cyclone 100, the diameter at the bottom of the cyclone 100 is the same as the diameter at the top of the hopper 108, so there is no need for a transition piece to span between the two different diameters to connect the top edge of the hopper to the bottom edge of the cyclone. In fact, there is no noticeable transition whatsoever from the tapering in diameter of the bottom portion of the cyclone 100 to the tapering diameter of the hopper 108. With respect to the baffle arrangement 99, it is substantially identical to the baffle arrangement 29 of FIG. 4. The baffles 104 have a tapered outer edge that abuts and rests on the tapered wall of the hopper 108. The operation of this cyclone 100 is substantially identical to the operation of the cyclones described earlier, with the main difference being the absence of a marked transition point between the bottom edge of the frusto-conical portion 106 of the cyclone 100 and the top edge of the hopper 108. Despite the absence of this transition and thus the absence of an abrupt increase in diameter to slow down the rotational velocity of the fluid stream so as to allow the particles to disengage from the fluid stream and fall down to the dip leg 107, the baffles 104 function in the same manner as the baffles 42 of FIG. 5, wherein the particles impinge against the baffles 104 and are forced to stop their rotational motion and drop down to the dip leg 107.

Figures 18, 19, 20:
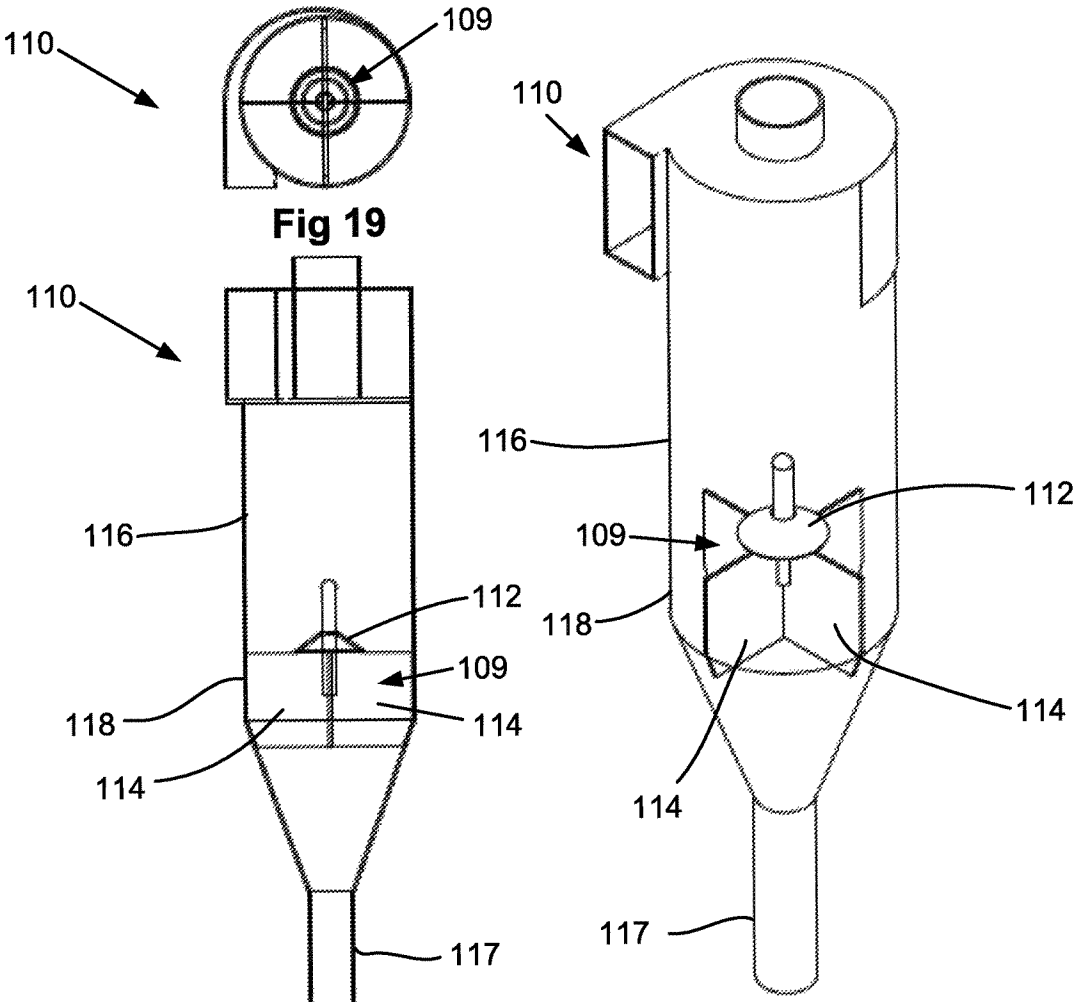
FIG. 18 is a side view, similar to that of FIG. 15, of another embodiment of a cyclone separator.
FIG. 19 is a plan view of the cyclone separator of FIG. 18.
FIG. 20 is a perspective view of the cyclone separator of FIG. 18.

FIGS. 18 through 20 show a cyclone 110 with a cylindrical wall 116 and a cylindrical upper portion of the hopper 118 and a tapered lower portion of the hopper 118, as explained below.

In this embodiment of the cyclone 110, both the cyclone 110 and the upper portion of the hopper 118 are cylindrical and have the same diameter, so there is no need for a transition piece to extend between the bottom edge of a larger diameter hopper and the top edge of a smaller diameter cyclone bottom. In fact, there is no noticeable transition whatsoever from the bottom of the cyclone wall 116 to the top of the hopper 118. With respect to the baffle arrangement 109, it is very similar to the baffle arrangement 89 of FIG. 14, with the exception that this baffle arrangement 109 includes a concave-side-up member 112, similar to the member 52 of the cyclone 30 of FIG. 5, and the lower portion of the outer edge of the baffles 114 is tapered to match and to abut the tapered lower portion of the hopper 118, on which the baffles 114 rest.

The operation of this cyclone 110 is substantially identical to the operation of the cyclones described earlier, with the main difference being the absence of a transition point between the bottom of the cylindrical wall 116 of the cyclone and the top of the hopper 118. Despite the absence of this transition and thus the absence of an abrupt increase in diameter to slow down the rotational velocity of the fluid stream so as to allow the particles to disengage from the fluid stream and fall down to the dip leg 117, the baffles 114 function in the same manner as the baffles 42 of FIG. 5, wherein the particles impinge against the baffles 114 and are forced to stop their rotational motion and drop down through the bottom of the hopper to the dip leg 117. As with all the embodiments previously described, the baffles 114 are thin-walled, with the thickness of the wall being much less than the vertical height of the baffle. The vertical height is at least five times and preferably at least ten times the thickness of the baffle wall.

Figure 22:
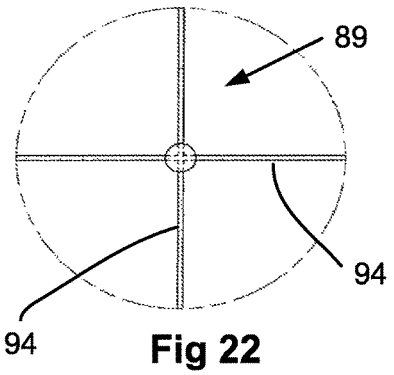
FIG. 22 is a plan view of the baffle arrangement of FIG. 21.
Figure 21:
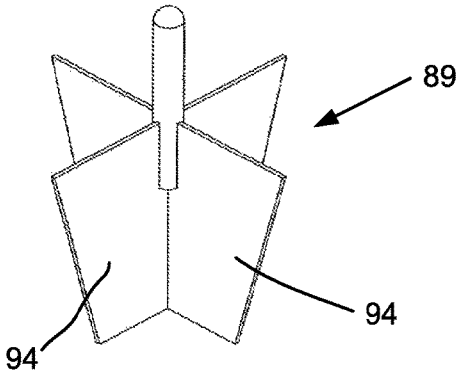
FIG. 21 is a perspective view of a baffle arrangement which is very similar to that shown in FIG. 11 (except that FIG. 21 includes a vortex-anchoring pin projecting from the top of the baffle arrangement)
Figure 24:
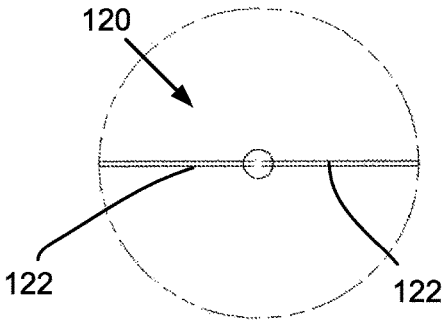
FIG. 24 is a plan view of the baffle arrangement of FIG. 23.
Figure 23:
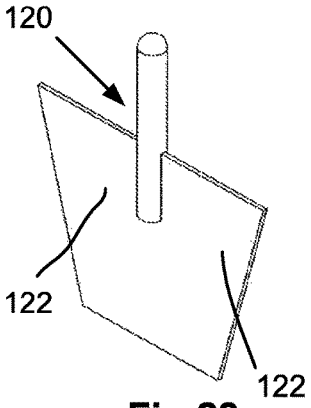
FIG. 23 is a perspective view of a baffle arrangement which is very similar to that shown in FIG. 21, except that this arrangement has two baffles instead of the four baffles of FIG. 21.
Figure 26:
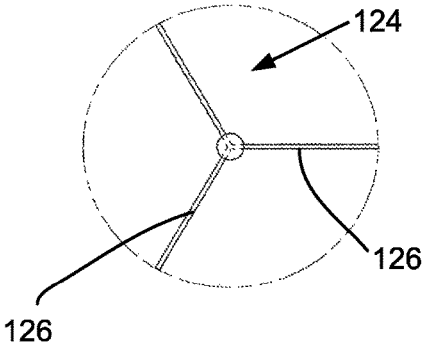
FIG. 26 is a plan view of the baffle arrangement of FIG. 25.
Figure 25:
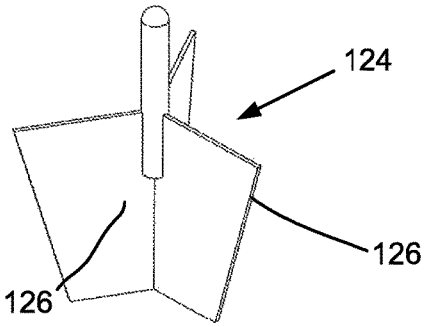
FIG. 25 is a perspective view of a baffle arrangement which is very similar to that shown in FIG. 21, except that this arrangement has three baffles instead of the four baffles of FIG. 21.
Figure 28:
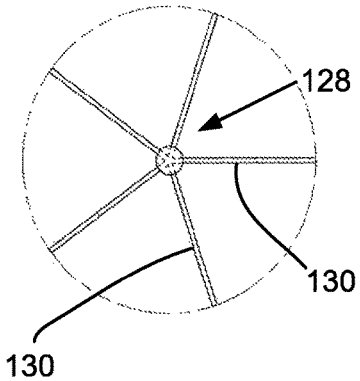
FIG. 28 is a plan view of the baffle arrangement of FIG. 27.
Figure 27:
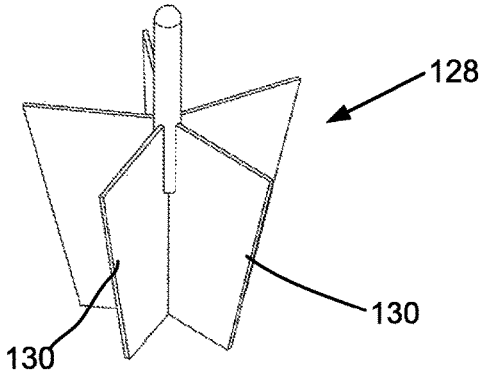
FIG. 27 is a perspective view of a baffle arrangement which is very similar to that shown in FIG. 21, except that this arrangement has five baffles instead of the four baffles of FIG. 21.
Figure 30:
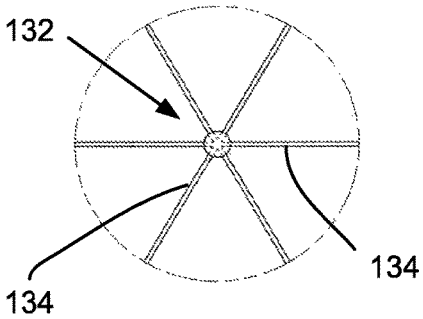
FIG. 30 is a plan view of the baffle arrangement of FIG. 29.
Figure 29:
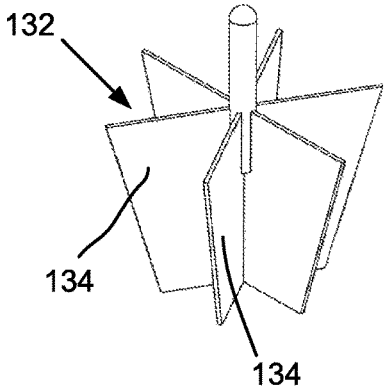
FIG. 29 is a perspective view of a baffle arrangement which is very similar to that shown in FIG. 21, except that this arrangement has six baffles instead of the four baffles of FIG. 21.

FIGS. 21 and 22 depict the baffle arrangement 89 of FIG. 14 wherein the four equally-spaced-apart baffles 94 divide the volume of the hopper 98 into open quadrants through which the particles to fall down to the dip leg 97. While the baffle arrangements shown thus far in this specification have had four baffles, that does not have to be the case. For instance, the alternative baffle arrangement 120 of FIGS. 23 and 24 has only two equally-spaced-apart baffles 122 at 180 degrees to each other. The alternative baffle arrangement 124 of FIGS. 25 and 26 has three, equally-spaced-apart baffles 126. The baffle arrangement 128 of FIGS. 27 and 28 has five equally-spaced-apart baffles 130. The baffle arrangement 132 of FIGS. 29 and 30 has six equally-spaced-apart baffles 134. Any desired number of baffles could be supplied as alternative embodiments of the invention.

Figures 31, 32, 33, 34:
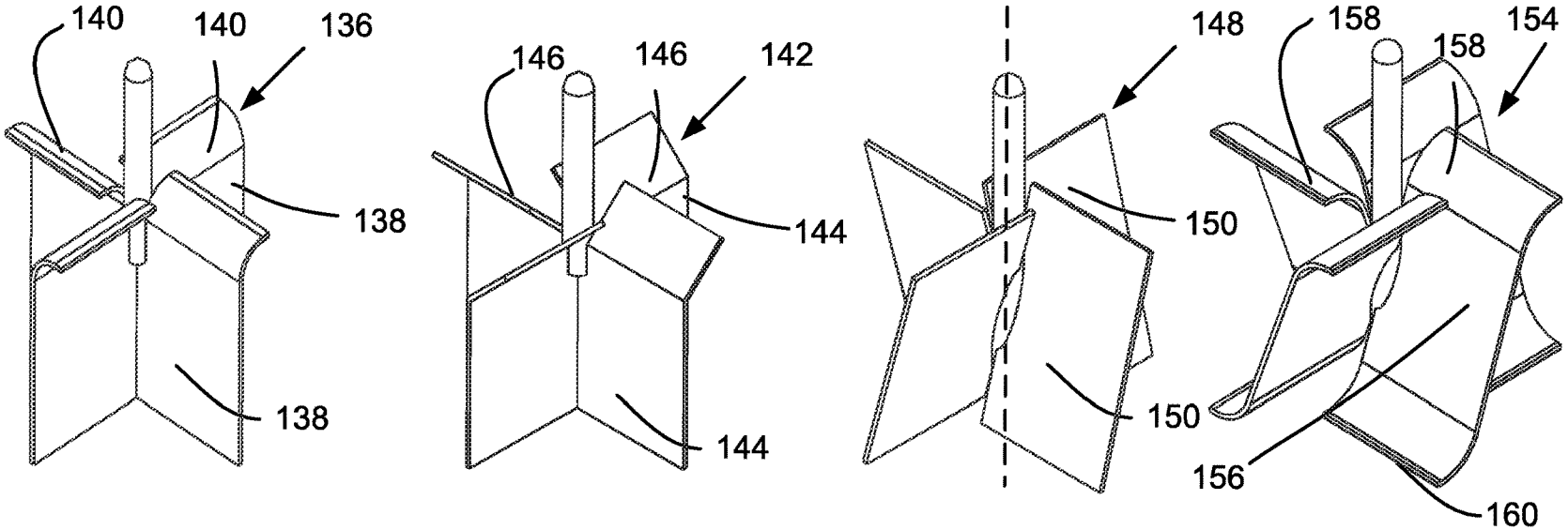
FIG. 31 is a perspective view of a baffle arrangement similar to that of FIG. 21, except that the upper edges of the baffles define curved portions which are inclined relative to the central vertical axis of the cyclone and act in the same manner as an inducer acts on a pump impeller.
FIG. 32 is a perspective view of a baffle arrangement similar to that of FIG. 31, except that the inclined, inducer portions are flat instead of curved.
FIG. 33 is a perspective view of a baffle arrangement similar to that of FIG. 32, except that the baffles themselves are flat and the whole baffle is inclined relative to the central vertical axis of the cyclone.
FIG. 34 is a perspective view of a baffle arrangement similar to that of FIG. 33, except that the inclined baffles define inclined, curved portions at both their upper edges and at their lower edges.

FIG. 31 is a perspective view of an alternative baffle arrangement 136, similar to that of FIG. 21, except that the leading edges of the baffles 138 define curved portions 140 which act in the same manner as an inducer acts on a pump impeller, namely, they guide the fluid flow to provide a more gradual transition from a mostly horizontal direction to a more vertical direction.

FIG. 32 is a perspective view of a baffle arrangement 142, similar to that of FIG. 31, except that the inducer portions 146 of the baffles 144 are flat instead of curved.

FIG. 33 is a perspective view of a baffle arrangement 148, similar to that of FIG. 21, except that the baffles 150 themselves are flat, with no inducer portions, but they are inclined relative to the central, vertical axis 152 of the cyclone.

FIG. 34 is a perspective view of a baffle arrangement 154, similar to that of FIG. 33, except that the inclined baffles 156 define curved inducer portions at both their leading edges 158 and at their trailing edges 160.

It is preferred that each of the baffles extends for at least half of the horizontal distance between the hopper wall and the vertical axis of the hopper. It should be noted that, while the present embodiments describe a first plurality of baffles, there may be additional baffles of various configurations as well, if desired.

While the embodiments described above show several arrangements for re-entrainment-defeating baffles, it will be obvious to those skilled in the art that modifications may be made to the embodiments described above without departing from the scope of the present invention as claimed.

What is claimed is:

1. A cyclone separator, comprising:

a cyclone separator wall having a bottom edge, said cyclone separator wall defining a cyclone central vertical axis;

a hopper wall having a top edge defining a horizontal radius, said top edge being connected to said bottom edge of said cyclone separator wall and having a bottom edge connected to a dip leg, said hopper wall defining a vertical axis and an interior space, and said dip leg providing a path through which particles may fall in order to exit said interior space;

a baffle arrangement inside said interior space, said baffle arrangement comprising a first plurality of baffles defining spaces between the baffles through which particles may flow through the interior space to the dip leg, each of said baffles having a wall thickness and a vertical height, wherein the vertical height is at least five times the wall thickness, and wherein each of said baffles extends for at least half of the horizontal distance between said hopper wall and said vertical axis.

2. A cyclone separator as recited in claim 1, wherein each baffle in said first plurality of baffles extends the horizontal distance between said hopper wall and said vertical axis.

3. A cyclone separator as recited in claim 1, wherein said hopper wall is tapered, and said baffles rest on said tapered hopper wall.

4. A cyclone separator as recited in claim 2, wherein said hopper wall is tapered, and said baffles rest on said tapered hopper wall.

5. A cyclone separator as recited in claim 1, and further comprising a vortex-anchoring device which is mounted on said baffle arrangement and projects upwardly above said hopper wall.

6. A cyclone separator as recited in claim 4, and further comprising a vortex-anchoring device which is mounted on said baffle arrangement and projects upwardly above said hopper wall.

7. A cyclone separator as recited in claim 6, wherein said vortex-anchoring device includes a vortex-anchoring pin coaxial with said cyclone vertical axis.

8. A cyclone separator as recited in claim 7, wherein said vortex-anchoring device includes a circular cross-section, upwardly-convex member, and said vortex-anchoring pin projects upwardly from said circular cross-section, upwardly-convex member.

9. A cyclone separator as recited in claim 7, wherein said vortex-anchoring device includes a cylinder, and said vortex-anchoring pin projects upwardly beyond said cylinder.

10. A cyclone separator as recited in claim 9, wherein said cylinder is hollow.

11. A cyclone separator as recited in claim 1, wherein each of the baffles in said first plurality of baffles defines a leading edge and a trailing edge, and at least one of said leading edges is inclined relative to the central vertical axis of the cyclone.

12. A cyclone separator as recited in claim 11, wherein each of said leading edges is inclined relative to said central vertical axis of the cyclone.

13. A cyclone separator as recited in claim 7, wherein each of said baffles in said first plurality of baffles extends the horizontal distance between said hopper wall and said vertical axis.

14. A cyclone separator as recited in claim 13, wherein each of the baffles in said first plurality of baffles defines a leading edge and a trailing edge, and said leading edges are inclined relative to said central vertical axis of the cyclone.

* * * * *